US008100246B2

(12) United States Patent
Nishida

(10) Patent No.: US 8,100,246 B2
(45) Date of Patent: Jan. 24, 2012

(54) COIN ACCOMMODATING AND DISPENSING DEVICE

(75) Inventor: Eisei Nishida, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 97 days.

(21) Appl. No.: 12/440,782

(22) PCT Filed: Sep. 11, 2006

(86) PCT No.: PCT/JP2006/317953

§ 371 (c)(1),
(2), (4) Date: Mar. 11, 2009

(87) PCT Pub. No.: WO2008/032350

PCT Pub. Date: Mar. 20, 2008

(65) Prior Publication Data

US 2010/0042250 A1 Feb. 18, 2010

(51) Int. Cl.
*G07D 1/00* (2006.01)

(52) U.S. Cl. ..... 194/302; 194/344

(58) Field of Classification Search ..... 194/302, 194/344; 453/18, 33, 34, 35, 49, 57
See application file for complete search history.

(56) References Cited

U.S. PATENT DOCUMENTS 3,187,760 A * 6/1965 Simjian ..... 453/17
5,114,381 A * 5/1992 Ueda et al. ..... 453/57
6,328,646 B1 * 12/2001 Abe et al. ..... 453/56
6,637,578 B1 * 10/2003 Ono et al. ..... 194/346
2006/0113161 A1 * 6/2006 Umeda ..... 194/302

FOREIGN PATENT DOCUMENTS

| | | | |
|---|---|---|---|
| CA | 2 592 520 | | 7/2006 |
| EP | 1 679 667 | A1 | 7/2006 |
| JP | 3-282693 | A * | 12/1991 |
| JP | 10-228556 | A | 8/1998 |
| JP | 2002-260067 | A | 9/2002 |
| JP | 2004-334597 | A | 11/2004 |
| JP | 2006-185237 | | 7/2006 |
| JP | 2006-185238 | A | 7/2006 |

OTHER PUBLICATIONS

European Search Report (Application No. 06797779.3-1229 / 2063401 PCT/JP2006317953) (dated Jul. 26, 2010—7 pages).
European Examination Report (Application No. 06 797 779.3-1229) (Dated Jun. 10, 2011—4 pages).

* cited by examiner

*Primary Examiner* — Mark Beauchaine
(74) *Attorney, Agent, or Firm* — Renner, Kenner, Greive, Bobak, Taylor & Weber

(57) ABSTRACT

A cyclic transporting unit is provided. The transporting unit transports coins one by one in reverse directions in depositing and dispensing. A plurality of accommodating and dispensing portions are arranged along the transporting unit. Since coins enter and exit the transporting unit through a single coin inlet/outlet of the accommodating and dispensing portion, a depositing and transporting route and a dispensing and transporting route of the transporting unit can be made common to each other. The accommodating and dispensing portion accommodates coins with the coins not aligned, and dispenses accommodated coins one by one to the transporting unit by a rotary disc and a delivering disc.

12 Claims, 11 Drawing Sheets

COIN ACCOMMODATING AND DISPENSING DEVICE

CROSS REFERENCED TO RELATED APPLICATION

This is a U.S. national phase application under U.S.C. §371 of International Patent Application No. PCT/2006/317953 filed Sep. 11, 2006. The International Application was published on Mar. 20, 2008 in Japanese as International Publication No. WO/2008/032350 under PCT Article 21(2) the contents of which are incorporated herein in its entirety.

TECHNICAL FIELD

The present invention relates to a coin accommodating and dispensing device capable of accommodating and dispensing coins.

BACKGROUND OF THE INVENTION

Coin depositing and dispensing machines, electrically connected to a POS cash register, an electronic cash register, a teller management machine, or other cashier equipment and enabling depositing and dispensing of cash to be performed automatically according to electrical signals output from such cashier equipment, have been developed conventionally for performing cash transactions with customers accurately and rapidly at a cash register in a store or, in a financial institution, at a counter or an ATM (Automatic Tellers Machine) installed inside or outside a banking branch.

In such a coin depositing and dispensing machine, a coin accommodating and dispensing device is used for accommodating coins to be deposited and dispensing coins to be dispensed. The coin accommodating and dispensing device has an accommodating cylindrical portion for piling up and accommodating coins for each denomination, and the coins can be accommodated and dispensed through an upper portion of the accommodating cylindrical portion. The coin accommodating and dispensing device, in accommodating coins, receives coins dropping from a diverting passage region of a coin passage disposed above the device, and in dispensing coins, dispenses coins, through the upper portion of each accommodating cylindrical portion, to a transporting conveyer for dispensing for receiving and collecting coins to be dispensed (see, for example, Japanese Laid-Open Patent Publication No. 2004-334597 (pages 7-9, FIG. 1)).

Additionally, in the coin depositing and dispensing machine, a coin pooling and feeding device is used for receiving and feeding coins to the coin passage one by one. The coin pooling and feeding device has a rotary disc for feeding coins, receives and accommodates coins to be deposited-released from a coin depositing portion, coins to be dispensed-released from the transporting conveyer for dispensing, and the like, and feeds the coins one by one by rotation of the rotary disc.

As a circumstance surrounding coin depositing and dispensing machines used for coin register change machines for stores or in financial institutions, there has been an increasing demand for coin depositing and dispensing machines that are more compact and lower priced than conventional machines.

However, since the conventional coin depositing and dispensing machine piles up and accommodates coins in accommodating cylindrical portions, a depositing and transporting route does not completely become the same as a dispensing and transporting route, thereby preventing downsizing and cost reductions. Additionally, a coin pooling and feeding device and a piling-up type coin accommodating and dispensing device are used in the coin depositing and dispensing machine. Although the devices have a common basic function of accommodating and feeding coins, components thereof for embodying the function are entirely different from each other, and cost is likely to rise with an increase in the number of components. Additionally, since the piling-up type coin accommodating and dispensing device is required to use accommodating cylinders corresponding to the diameters of coins, considerable improvements are required for coping with coins having diameters greatly different by denomination, for example, foreign coins.

Additionally, since coins are piled up and accommodated in the accommodating cylindrical portion, there is a possibility that the coins are not correctly piled up and stand up when the coins are accommodated. If the coins are accommodated in a standing state, a dispensing error will occur in dispensing, thereby causing a device breakdown.

The present invention has been made in view of the above problems, and an object thereof is to provide a coin accommodating and dispensing device which is capable of securely accommodating and dispensing coins, and in the case of being used for coin depositing and dispensing machines, for example, downsizing and manufacturing at low cost by making a depositing and transporting route and a dispensing and transporting route common to each other or having a constitution common to that of a coin pooling and feeding device.

SUMMARY OF THE INVENTION

A coin accommodating and dispensing device of the present invention includes a transporting unit for transporting coins one by one, and accommodating and dispensing portions each of which has a coin inlet/outlet, through which coins enter/exit the transporting unit, receives and accommodates coins, which are transported one by one by the transporting unit with the coins not aligned, and dispenses accommodated coins one by one through the coin inlet/outlet to the transporting unit.

Coins are made to enter/exit one by one the transporting unit for transporting coins one by one through the port, which serves concurrently as entrance and exit of coins, of each accommodating and dispensing portion. Thus, in the case where the coin accommodating and dispensing device is used for coin depositing and dispensing machines, for example, a depositing and transporting route and a dispensing and transporting route can be made common to each other, or the constitution of the device can be made common to that of a coin pooling and feeding device. Additionally, since coins are accommodated in the coin accommodating and dispensing portion in a non-aligned state, there arises no problem such that coins cannot be correctly accommodated and stand up in the case of being piled up and accommodated in a cylinder. Thus, the coins are securely accommodated and dispensed.

With a coin accommodating and dispensing device according to of the present invention, in the coin accommodating and dispensing device of the invention, the plurality of accommodating and dispensing portions are provided along the transporting unit.

Coins can be sorted for each denomination and accommodated in a plurality of accommodating and dispensing portions corresponding to the denomination.

With a coin accommodating and dispensing device according to the present invention, the transporting unit can transport coins in a normal or reverse direction.

Coins to be made to enter and exit the accommodating and dispensing portions can be transported.

With a coin accommodating and dispensing device of the present invention, the invention includes an identifying portion for identifying denominations of coins transported by the transporting unit, and a controlling portion for sorting the coins transported by the transporting unit into the accommodating and dispensing portions in accordance with identification results of the identifying portion.

Coins transported by the transporting unit can be sorted and accommodated into the accommodating and dispensing portions in accordance with the identification results of the identifying portion.

With a coin accommodating and dispensing device includes an identifying portion for identifying denominations of coins transported by the transporting unit, and sorting members for sorting the coins transported by the transporting unit into the accommodating and dispensing portions in accordance with identification results of the identifying portion.

Coins transported by the transporting unit can be sorted and accommodated into the accommodating and dispensing portions by the sorting members in accordance with the identification results of the identifying portion.

A coin accommodating and dispensing device according to the present invention, the accommodating and dispensing portion includes: a rotary disc which is attached to a rotary shaft and rotates at a position of tilting at a predetermined angle relative to a horizontal direction; a hopper for accommodating coins at a surface side of the rotary disc; picking-up members which project from the surface of the rotary disc and pick up accommodated coins one by one by rotation of the rotary disc; and a delivering disc which is disposed in the vicinity of the coin inlet/outlet, and receives and delivers the coins picked up one by one by the picking-up members at a predetermined interval to the transporting unit.

Coins are accommodated between the rotary disc and the hopper in the non-aligned state, the coins in the hopper are picked up one by one by the picking-up members by the rotation of the rotary disc and delivered to the transporting unit by the delivering disc, and thus dispensed one by one.

The present invention, contains a transporting unit which includes an endless transporting body and a plurality of projecting portions which project from the transporting body, and push and transport coins one by one.

Coins are received one by one between the plurality of projecting portions of the transporting body, and pushed and transported one by one by the projecting portions.

A coin accommodating and dispensing device of the present invention, includes a controlling portion for driving the transporting unit in a first direction when coins are accommodated in the accommodating and dispensing portions, and driving the transporting unit in a second direction different from the first direction when coins are dispensed from the accommodating and dispensing portions.

Coins can be accommodated in or dispensed from the accommodating and dispensing portions in accordance with the driving directions of the transporting unit.

The coin accommodating and dispensing device according to the invention includes a controlling portion for driving the transporting unit in a first direction when coins are accommodated in the accommodating and dispensing portions, and driving the transporting unit in a second direction different from the first direction when coins are dispensed from the accommodating and dispensing portions, the transporting unit includes a coin passage which transports coins and has, in its width direction, one side in which the coin inlets/outlets of the accommodating and dispensing portions are provided, and the sorting member includes: a coin guiding portion which is provided so that one side, which is located at the coin inlet/outlet side of the coin passage, of the guiding portion is, relative to another side located at a side opposite from the coin inlet/outlet, tilted toward a downstream side, at a predetermined angle, in a transporting direction when the transporting unit is driven in the first direction, and is provided in a concavely curved face shape facing an upstream side in a transporting direction when the transporting unit is driven in the first direction; and a blocking portion for preventing coins from entering the coin inlet/outlet.

Sorting and passage of coins relative to the coin inlet/outlet of the accommodating and dispensing portion can be selected by the sorting member.

With a coin accommodating and dispensing device according to the above, the sorting member is electrically driven, the coin guiding portion projects from the coin passage and the blocking portion makes the coin inlet/outlet open when coins are sorted into the accommodating and dispensing portion, and the coin guiding portion is buried in the coin passage and the blocking portion makes the coin inlet/outlet close when no coin is sorted into the accommodating and dispensing portion.

The sorting member is electrically driven and makes switching between the sorting and passage of coins relative to the coin inlet/outlet of the accommodating and dispensing portion.

In the coin accommodating and dispensing device according to the invention, the transporting unit transports coins, in a manner that the lateral face of the one side of the projecting portion comes into contact with the coin, when the coins are accommodated in the accommodating and dispensing portions, and transports coins, in a manner that the lateral face of another side of the projecting portion comes into contact with the coin, when coins are dispensed from the accommodating and dispensing portions.

Coins can be transported by the projecting portions when the coins are accommodated in and dispensed from the accommodating and dispensing portions.

In the coin accommodating and dispensing device according to the invention, the delivering disc includes, in its outer circumference, at least one projecting body for coming into contact with a coin.

The projecting body of the delivering disc receives and delivers coins picked up one by one by the picking-up members of the rotary disc to the transporting unit.

According to a coin accommodating and dispensing device of the present invention, since coins can be, through a single coin inlet/outlet of an accommodating and dispensing portion, made to enter/exit one by one a transporting unit for transporting coins one by one, a depositing and transporting route and a dispensing and transporting route can be made common to each other, the constitution of the device can be made common to that of a coin pooling and feeding device, and the accommodating and dispensing device can be downsized and manufactured at low cost, in the case where the device is used for coin depositing and dispensing machines, for example. Additionally, since coins are accommodated in the accommodating and dispensing portion in a non-aligned state, there arises no problem such that coins cannot be correctly accommodated and stand up in the case of being piled up and accommodated in a cylinder. Thus, coins can be securely accommodated and dispensed.

According to a coin accommodating and dispensing device of the present invention, in addition to the effect of the coin accommodating and dispensing device above, coins can be sorted and accommodated for each denomination since the plurality of accommodating and dispensing portions are provided along the transporting unit.

In addition to the effect of the coin accommodating and dispensing device, since coins can be transported by the transporting unit in a normal or reverse direction, coins can be made to enter and exit the accommodating and dispensing portions and can be transported by the transporting unit.

According to a coin accommodating and dispensing device of claim 4 of the present invention, coins transported by the transporting unit can be sorted and accommodated in the accommodating and dispensing portions in accordance with identification results of an identifying portion.

According to a coin accommodating and dispensing device, coins transported by the transporting unit can be sorted and accommodated by sorting members into the accommodating and dispensing portions in accordance with the identification results of the identifying portion.

In addition to the effect of the coin accommodating and dispensing device of the invention, coins can be accommodated between a rotary disc and a hopper in the non-aligned state, and the coins in the hopper are picked up one by one by picking-up members by rotation of the rotary disc, delivered to the transporting unit by a delivering disc, and can be dispensed one by one.

According to a coin accommodating and dispensing device of claim 7 of the present invention, an endless transporting body having a plurality of projecting portions is used as the transporting unit, and coins are received between the plurality of projecting portions of the transporting body one by one, and can be pushed and transported one by one by the projecting portions.

Accordingly, in addition to the effect of the coin accommodating and dispensing device of the above, since the transporting unit is driven in a first direction when coins are accommodated in the accommodating and dispensing portions, and driven in a second direction different from the first direction when coins are dispensed from the accommodating and dispensing portions, the coins can be made to enter and exit the accommodating and dispensing portions in accordance with the driving directions of the transporting unit.

According to the present invention, the sorting member includes a coin guiding portion for guiding coins transported by the transporting unit in the coin passage to the coin inlet/outlet of the accommodating and dispensing portion, and a blocking portion for preventing coins from entering the coin inlet/outlet, and can select sorting and passage of coins relative to the coin inlet/outlet of the accommodating and dispensing portion. According to a coin accommodating and dispensing device, the sorting member is electrically driven, the coin guiding portion projects from the coin passage and the blocking portion makes the coin inlet/outlet open and thus coins can be sorted into the accommodating and dispensing portion, and the coin guiding portion is buried in the coin passage and the blocking portion makes the coin inlet/outlet close and thus coins can be made to pass through the accommodating and dispensing portion without being sorted thereinto.

According to a coin accommodating and dispensing device of the present invention, in addition to the above, when coins are accommodated in the accommodating and dispensing portion, the lateral face of the one side of the projecting portion comes into contact with coins so that the coins can be transported. Additionally, when coins are dispensed from the accommodating and dispensing portion, the lateral face of another side of the projecting portion comes into contact with the coins so that the coins can be transported.

According to a coin accommodating and dispensing device of the present invention, at least one projecting body provided at an outer circumference of the delivering disc can receive and deliver coins picked up one by one by the picking-up members of the rotary disc to the transporting unit.

DETAILED DESCRIPTION OF THE INVENTION

Hereinafter, embodiments of the present invention will be described with reference to the drawings.

FIGS. 1 to 10 show an embodiment.

Figure 1:
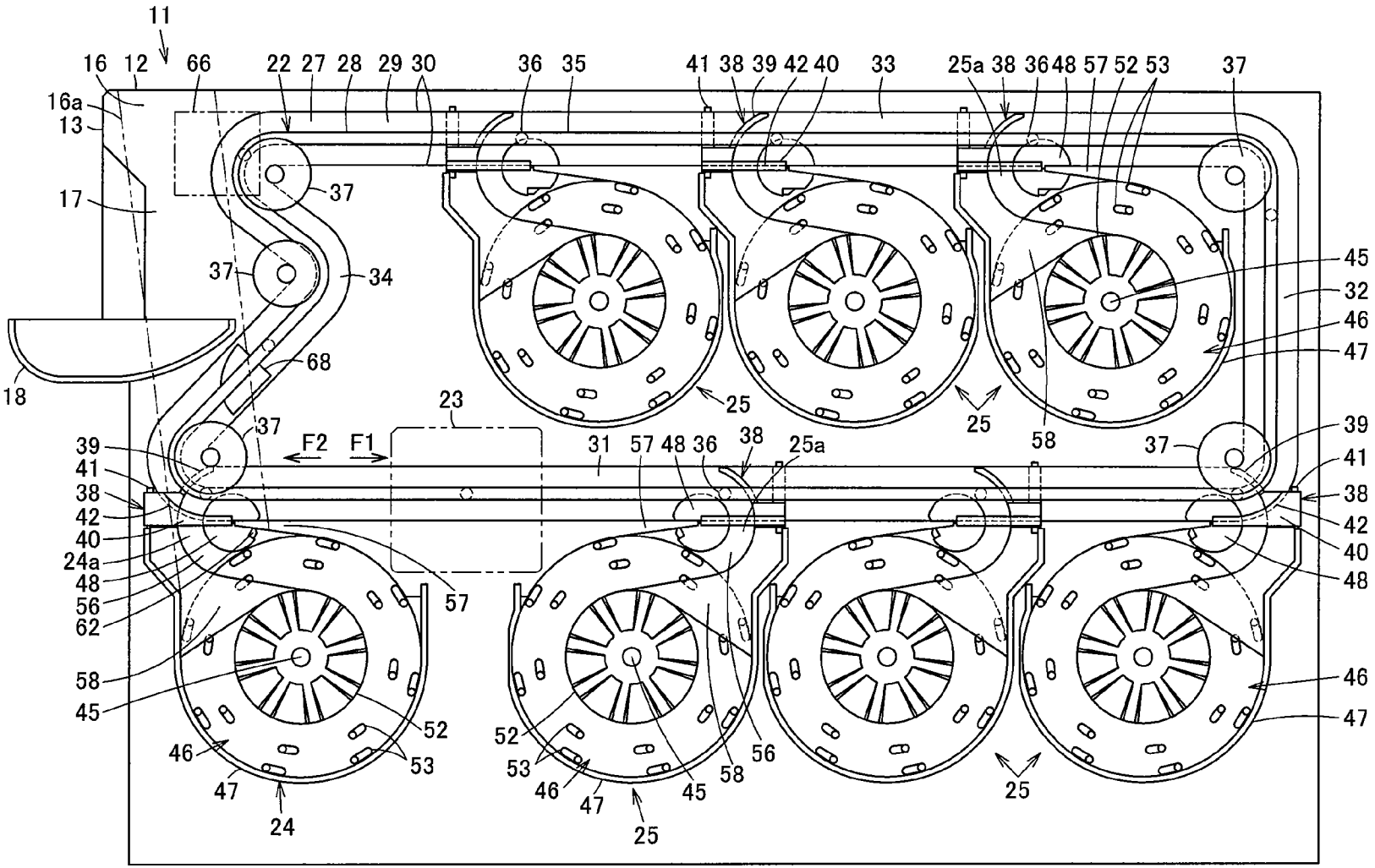
FIG. 1 is a side view showing an inner structure of a coin depositing and dispensing machine to which a coin accommodating and dispensing device of an embodiment of the present invention is applied.
Figure 2:
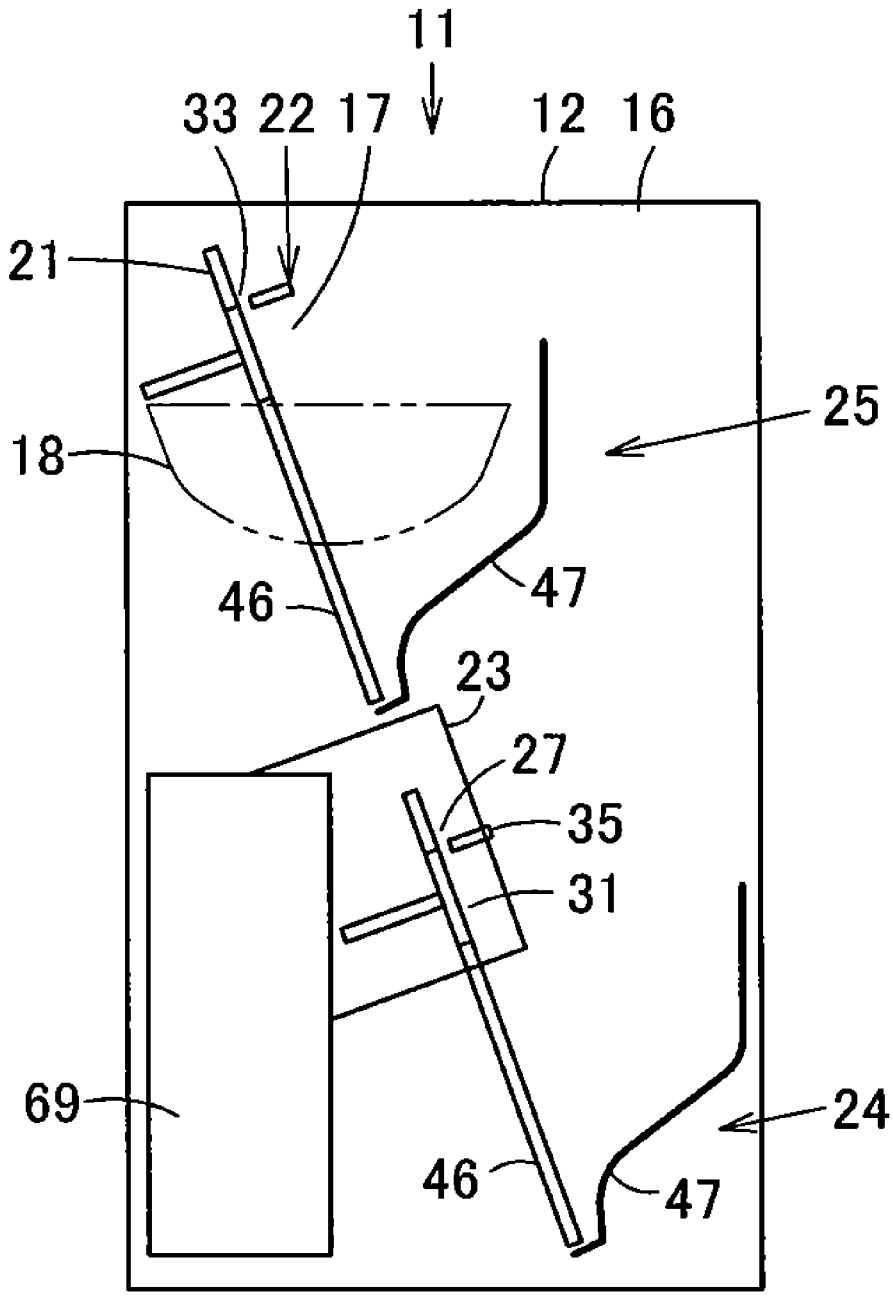
FIG. 2 is a front view showing the inner structure of the coin depositing and dispensing machine.

As shown in FIGS. 1 and 2, a coin depositing and dispensing machine 11 includes a machine body 12, and an operating surface 13, on which customers perform inputting operation of coins to be deposited and taking-out operation of dispensed coins, is formed in the front (left side in FIG. 1) of the machine body 12.

In the operating surface 13 of the machine body 12, a coin receiving port 16, through which coins to be deposited, etc., are input into the machine body 12, and a coin dispensing port 17, through which coins to be dispensed, etc., are dispensed from the machine body 12, are juxtaposed in a lateral direction when viewed from the front side of the machine body, and further a receptacle 18 for receiving the coins dispensed from the coin dispensing port 17 is disposed.

In the machine body 12, a base 21 is disposed, the base having an upper portion tilted at a predetermined angle in a left direction (backside direction of the base 21) when viewed from the front of the machine body. The following unit and portions, etc., are disposed on a surface side directed upward of the base 21: a transporting unit 22 for transporting coins; an identifying portion 23 for identifying denominations of coins transported by the transporting unit 22; a pooling and feeding portion 24 which can receive and feed coins input into the coin receiving port 16 to the transporting unit 22 one by one, and can make coins enter and exit the transporting unit 22 one by one; and a plurality of accommodating and dispensing portions 25 which accommodates coins for each denomination and can make coins enter and exit the transporting unit 22 one by one. A chute 16*a* for guiding coins input into the coin receiving port 16 to the pooling and feeding portion 24 is disposed between the coin receiving port 16 and the pooling and feeding portion 24. A coin accommodating and dispensing device is constituted by the transporting unit 22, accommodating and dispensing portion 25 and the like.

The transporting unit 22 includes a cyclic coin passage 27 for making coins align, and guiding and transporting them, and an endless transporting body 28 for transporting the coins in the coin passage 27.

The coin passage 27 includes a passage face 29 which is formed of a surface of the base 21 and comes into contact with the surfaces of coins, and guide side plates 30 which are provided at both sides of the passage face 29 and guides the circumferences of coins. The following portions are formed in the coin passage 27: a first passage portion 31 provided so as to run from the front side to the rear side of the machine body 12; a turning passage portion 32 for turning the coin passage from a terminal end of the first passage portion 31 to the front side of the machine body 12; a second passage portion 33 provided so as to run from the terminal end of the turning passage portion 32 to the front side of the machine body 12 and have a terminal end directed to the coin dispensing port 17; and a return passage portion 34 connected to a starting end of the first passage portion 31 from the terminal end of the second passage portion 33.

The transporting body 28 is composed of an endless belt 35. A plurality of projecting portions 36 are projected from a surface, which opposes the passage face 29, of the belt 35 at a predetermined pitch in a longitudinal direction of the belt. The belt 35 is tensioned by a plurality of pulleys 37 so as to circulate through a central region of the coin passage 27. Coins are received between the projecting portions 36 adjacent to each other on the belt 35, and transported while being pushed by the projecting portions 36 by rotation of the belt 35. Any one of the pulleys 37 is driven by a motor in a normal or reverse direction. That is, when depositing coins are fed from the pooling and feeding portion 24 and accommodated in the accommodating and dispensing portions 25, the belt 35 is driven in a first direction (hereinafter, referred to as a depositing and transporting direction F1) as the normal direction so as to move from the front side to the rear side in the first passage portion 31. On the other hand, when dispensing coins are fed from the accommodating and dispensing portions 25 and dispensed to the coin dispensing port 17, the belt 35 is driven in a second direction (hereinafter, referred to as a dispensing and transporting direction F2) reverse to the depositing and transporting direction F1. Accordingly, normal or reverse driving of the belt 35 allows coins in the coin passage 27 to be transported in the normal or reverse direction.

The pooling and feeding portion 24 is disposed at the front side on the lower side of the first passage portion 31 of the coin passage 27, and a plurality of, for example, three accommodating and dispensing portions 25 are disposed, at the rear side relative to the pooling and feeding portion 24, along the first passage portion 31. On the lower side of the second passage portion 33, a plurality of, for example, three accommodating and dispensing portions 25 are disposed on the lower side of and along the second passage portion 33. In the first passage portion 31, the identifying portion 23 is disposed between the pooling and feeding portion 24 and the head accommodating and dispensing portion 25.

A coin inlet/outlet 24*a*, through which coins can enter/exit the coin passage 27, of the pooling and feeding portion 24 is formed in a manner that a part of the guide side plate 30 at the lower side of the first passage portion 31 is opened. A coin inlet/outlet 25*a*, through which coins can enter/exit the coin passage 27, of each accommodating and dispensing portion 25 is formed in a manner that a part of the guide side plate 30 at the lower sides of the passage portions 31, 33 is opened. Sorting members 38 are disposed at positions of the coin inlet/outlet 24*a* and each coin inlet/outlet 25*a* of the coin passage 27, the sorting member for selectively sorting coins in accordance with determination of whether making coins enter/exit the transporting unit 22 through the coin inlet/outlet 24*a* and each coin inlet/outlet 25*a* or making coins transported by the transporting unit 22 pass toward a downstream side in a transporting direction. Each sorting member 38 for the pooling and feeding portion 24 and each accommodating and dispensing portion 25 are formed so as to have the same basic constitution of sorting coins although having directions different from each other.

Figure 3:
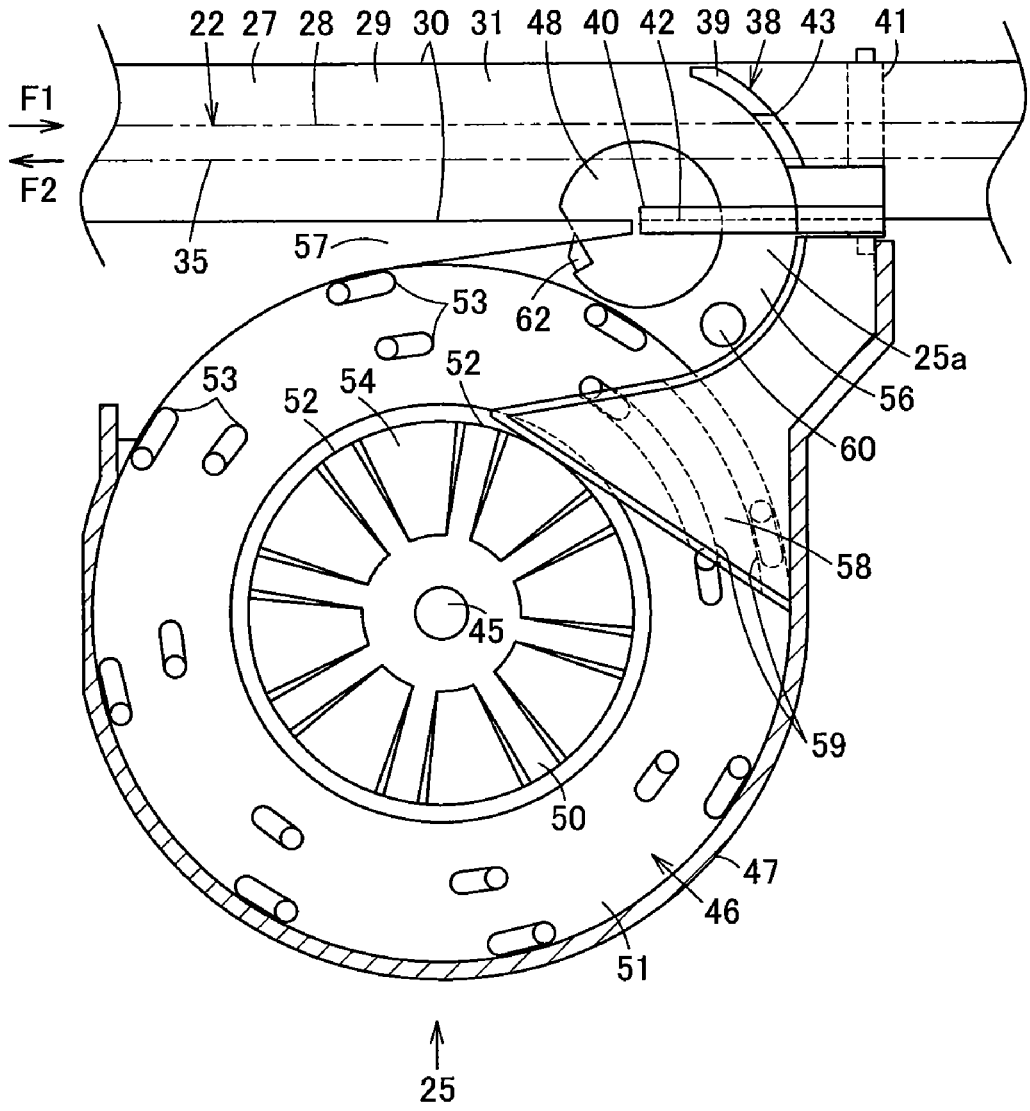
FIG. 3 is a front view of an accommodating and dispensing portion of the coin depositing and dispensing machine.

FIG. 3 shows one sorting member 38 for accommodating and dispensing portions 25. The sorting member 38 integrally includes a coin guiding portion 39 for guiding coins to the coin inlet/outlet 25*a*, a blocking portion 40 for preventing coins from entering the coin inlet/outlet 25*a*, and a supporting portion 41 for supporting the coin guiding portion 39 and blocking portion 40 swingably.

The coin guiding portion 39 is provided so that a lower side of the guiding portion, the lower side being one side, which is located at the coin inlet/outlet 25*a*, of the coin passage 27 in its width direction closing over its passage direction, is tilted, relative to an upper side of the guide portion, the upper portion being another side, which is located at a side opposite from the coin inlet/outlet 25*a*, of the coin passage 27 in the width direction, at a predetermined angle, toward the downstream side in the transporting direction when the transporting unit 22 is driven in the depositing and transporting direction F1. Additionally, the portion 39 is provided in a concavely curved face shape facing an upstream side in the transporting direction when the transporting unit 22 is driven in the depositing and transporting direction F1.

A guide face 42 is provided in the blocking portion 40, the face 42 guiding a circumference of a coin by becoming flush with the lower guide side plate 30 when the blocking portion 40 is closed.

The holding portion 41 is located at the downstream side in the depositing and transporting direction F1 relative to the coin guiding portion 39 and blocking portion 40, is rotatable about an axis of the coin passage 27 in its width direction as a fulcrum, and rotates by an electrical driving unit such as a solenoid. When coins are sorted from the coin passage 27 into the accommodating and dispensing portion 25 and fed from the accommodating and dispensing portion 25 to the coin passage 27, the sorting member 38 is located at a coin entering and exiting position where the coin guiding portion 39 projects from the passage face 29 of the coin passage 27 and the blocking portion 40 makes the coin inlet/outlet 25*a* open. On the other hand, when coins are neither sorted from the coin passage 27 into the accommodating and dispensing portion 25 nor fed from the accommodating and dispensing portion 25 to the coin passage 27, the sorting member 38 is located at a coin passing position where the coin guiding portion 39 is buried in the passage face 29 of the coin passage 27 and the blocking portion 40 makes the coin inlet/outlet 25*a* close. An opening, which the coin guiding portion 39 enters and exits, is formed in the passage face 29 of the coin passage 27. A groove 43, which prevents interference with the belt 35 when the portion 39 projects from the coin passage 27, is formed in the coin guiding portion 39 of the sorting member 38.

Moreover, the sorting member 38 for the pooling and feeding portion 24 includes the coin guiding portion 39 the same as that of the sorting member 38 for the accommodating and dispensing portion 25, the blocking portion 40 and the holding portion 41, and is driven by an electrical driving unit. Additionally, although the directions, etc., of the pooling and feeding portion 24 and each accommodating and dispensing portion 25 are different from each other, the portions 24, 25 are formed so as to have the same basic constitution of making coins enter and exit the transporting unit 22 one by one. One of the accommodating and dispensing portions 25 will be described with reference to FIG. 3. The accommodating and dispensing portion 25 includes: a rotary disc 46 rotatable around a rotary shaft 45 at a position (see FIG. 2) where an upper portion of the disc 46 is tilted at a predetermined angle relative to the horizontal direction so as to be directed in a backside direction of the disc 46; a hopper 47 for pooling a coin between it and a surface side of the rotary disc 46; and a delivering disc 48 arranged in the vicinity of the coin inlet/outlet 25*a*. The rotary disc 46 is rotatably arranged so that the surface of the rotary disc 46 is flush with the surface of the base 21. The rotary disc 46 moves with the belt 35 and the delivering disc 48, and rotation-drives by a motor in a feeding rotation direction (clockwise in FIG. 3) of feeding coins to the coin passage 27. The rotary disc 46 may be capable of rotation-driving in a reverse feeding rotation direction reverse to the feeding rotation direction so that a caused coin jam is removed when a coin jam occurs.

A circular high portion 50 is formed at a center region of the surface of the rotary disc 46, and an annular low portion 51 is formed at an outer circumferential region of the high portion 50. A step-shaped coin circumference holding portion 52, which has a size slightly smaller than the thickness of the smallest coin among coins to be processed and on which a circumference of one coin is mounted in its thickness direction, is formed between the high portion 50 and low portion 51 of the rotary disc 46.

A plurality of picking-up members 53 projecting from the surface of the rotary disc 46 are arranged on the low portion 51 along two circumference directions, inner circumference direction and outer circumference direction, at a predetermined pitch. Each picking-up member 53 on the outer circumference side is arranged at an upstream side in the feeding rotation direction of the rotary disc 46 relative to each picking-up member 53 on the inner circumference side. When the rotary disc 46 rotates in the feeding rotation direction, each picking-up member 53 on the inner circumference side holds coins one by one between the member 53 and the coin circumference holding portion 52 and picks up the coins to an upper region of the rotary disc 46, and each picking-up member 53 on the outer circumference side pushes out the coins, which are picked up to the upper region of the rotary disc 46 by each picking-up member 53 on the inner circumference side, toward the coin inlet/outlet 25*a* and delivers the coins to the delivering disc 48.

The coin circumference holding portion 52 is provided at each position where coins can be held one by one between the portion 52 and each picking-up member 53. Accordingly, the plurality of coin circumference holding portions 52 are provided in the circumference direction. Sliding-down portion 54 for sliding coins, which are not held between each picking-up member 53 and the coin circumference holding portion 52, downward are formed between the coin circumference holding portions 52, as a tilted face constituted by a difference between heights of the high portion 50 and low portion 51.

A guide passage 56 for feeding coins, which are picked up to the upper region of the rotary disc 46 by the picking-up members 53, toward the coin inlet/outlet 25*a* is formed at the upper region of the rotary disc 46. The guide passage 56 is formed between the passage face 29, which is the surface of the rotary disc 46 and the surface of the base 21 and is common to the coin passage 27, and guide members 57, 58 at upper and lower sides.

The upper guide member 57 which is projected from the surface of the rotary disc 46 and the passage face 29, form the upper region of the rotary disc 46 to one edge side of the coin inlet/outlet 25*a*.

The lower guide member 58 is provided from the coin circumference holding portion 52 side to another edge side of the coin inlet/outlet 25*a* in a state which opposes a surface of the low portion 51 at an interval that no coin is inserted. An inner edge, which faces the inside of the guide passage 56, of the guide member 58 is formed curved face continuous to the coin guiding portion 39 of the sorting member 38. Grooves 59, through which each revolving and moving picking-up member 53 pass, are formed in a surface, which oppose the low portion 51, of the guide member 58. The guide member 58 receives coins picked up by each picking-up member 53 from the coin circumference holding portions 52 and guides the coins to the coin inlet/outlet 25*a*.

A projecting portion 60 capable of entering and exiting the passage face 29 is disposed in the vicinity of the lower guide member 58 in the guide passage 56. The projecting portion 60 is electrically driven by a solenoid, etc. The portion 60 is buried in the passage face 29, when the blocking portion 40 of the sorting member 38 opens, to allow coins to pass, and projects from the passage face 29, when the blocking portion 40 moves to a closing position, to make coins in the guide passage 56 drop into the hopper 47.

Additionally, the hopper 47 is attached to the surface side of the base 21, and formed in a shape of being opened upward (see FIG. 2).

Figure 4:
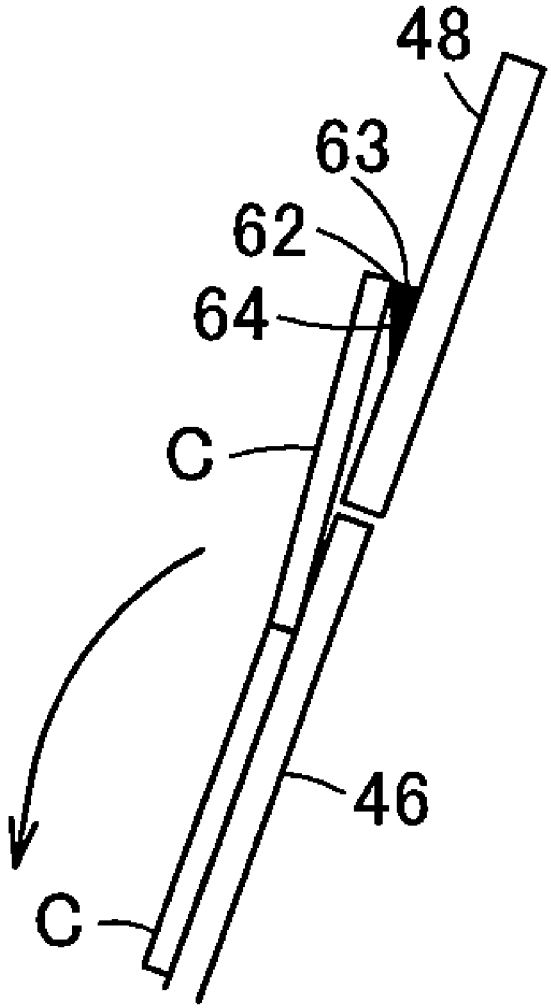
FIG. 4 is a cross sectional view showing a projecting body of a delivering disc of the accommodating and dispensing portion.

Additionally, the delivering disc 48 is rotatably arranged over the guide passage 56 and the coin passage 27 so that a surface of the delivering disc 48 becomes flush with the surface of the rotary disc 46 and the passage face 29 of the surface of the base 21. A projecting body 62, which comes into contact with and feeds coins from the rotary disc 46 side to the coin passage 27, is projected on an outer circumference of the delivering disc 48. The delivering disc 48 simultaneously rotates with the belt 35, and rotates, when the belt 35 moves in the dispensing and transporting direction F2, in a feeding rotation direction that the projecting body 62 moves from the coin inlet/outlet 25*a* into the coin passage 27, that is, a feeding rotation direction (counterclockwise in FIG. 3) that the projecting body 62 feeds coins from the rotary disc 46 side to the coin passage 27. Additionally, when the belt 35 moves in the depositing and transporting direction F1, the delivering disc 48 rotates in a reverse feeding rotation direction (clockwise in FIG. 3) that the projecting body 62 moves from the coin passage 27 side into the coin inlet/outlet 25*a*. As shown in FIG. 4, an engaging face 63, which is approximately perpendicular to the surface of the delivering disc 48 and engages with the circumference of a coin, is formed in a surface, which opposes the feeding rotation direction of the rotary disc 46, of the projecting body 62, and a tilted face 64, onto which a coin rises, is formed in an opposite surface of the projecting body 62.

Moreover, the accommodating and dispensing portion 25 provided on the second passage portion 33 and the accommodating and dispensing portion 25 provided on the first passage portion 31 have the same constitution, although being oppositely directed in accordance with a difference in the coin transporting directions of the first passage portion 31 and second passage portion 33. Additionally, the pooling and feeding portion 24 and the accommodating and dispensing portion 25 provided on the first passage portion 31 have the same basic constitution, although being oppositely directed. The delivering disc 48 rotates in the feeding rotation direction when the belt 35 moves in the depositing and transporting direction F1, and rotates in the reverse feeding rotation direction when the belt 35 moves in the dispensing and transporting direction F2.

Additionally, as shown in FIG. 1, a dispensing mechanism 66 for dispensing coins transported by the transporting unit 22 into the coin dispensing port 17 is disposed at the terminal end of the second passage portion 33. The dispensing mechanism 66 uses a sorting member having the same function as that of the sorting member 38 and can sort coins. Moreover, the dispensing mechanism 66, in depositing coins, serves as a reject sorting mechanism for sorting coins, which are identified as abnormal coins by the identifying portion 23, into the coin dispensing port 17 for return.

Additionally, as shown in FIG. 2, a diverting mechanism 68 for diverting overflow coins, which are not accommodated because the accommodating and dispensing portion 25 is filled with coins, from the coin passage 27 is disposed in the returning passage portion 34. An accommodating box 69 for accommodating the coins diverted by the diverting mechanism 68 is attachably/detachably disposed in the machine body 12.

Figure 5:
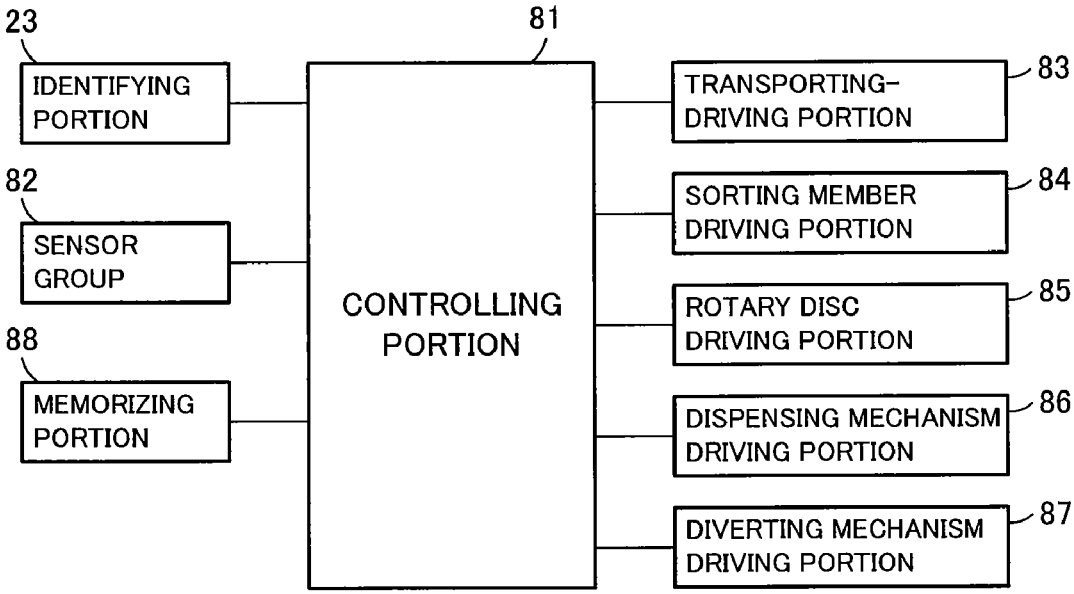
FIG. 5 is a block diagram of the coin depositing and dispensing machine.

FIG. 5 shows a block diagram of a controlling portion 81 for controlling the coin depositing and dispensing machine 11. The controlling portion 81 inputs signals from the identifying portion 23 for identifying denominations of coins, each sensor group 82 disposed in the coin depositing and dispensing machine 11, and the like, and controls: a transporting-driving portion 83 using a motor, etc., for driving the belt 35 and delivering disc 48; a sorting member driving portion 84 using a solenoid, motor or the like for driving the sorting members 38 of the pooling and feeding portion 24 and each accommodating and dispensing portion 25; a rotary disc driving portion 85 using a motor, etc., for driving each rotary disc 46; a dispensing mechanism driving portion 86 using a solenoid, motor or the like for driving the sorting member of the dispensing mechanism 66; a diverting mechanism driving portion 87 using a solenoid, motor or the like for driving the diverting mechanism 68; and the like.

As the sensor group, a plurality of sensors, which are provided at the coin passage 27 and detect positions of coins transported in the coin passage 27, sensors, which are provided at the guide passages 56 of the pooling and feeding portion 24 and each accommodating and dispensing portion 25 and detect entering and exiting of coins relative to the pooling and feeding portion 24 and each accommodating and dispensing portion 25, and the like are cited.

The controlling portion 81 includes a memorizing portion 88 for memorizing the number of coins accommodated in each accommodating and dispensing portion 25.

The controlling portion 81 has a function of sorting coins transported by the transporting unit 22 into the preset accommodating and dispensing portion 25 for each denomination in accordance with identification results of the identifying portion 23, and of driving the transporting unit 22 in the depositing and transporting direction F1 when coins are fed from the pooling and feeding portion 24 and accommodated in the accommodating and dispensing portions 25, and driving the transporting unit 22 in the dispensing and transporting direction F2 when coins are dispensed from the accommodating and dispensing portions 25 and dispensed to the coin dispensing port 17.

Further, the controlling portion 81 has a function of investigating, in the pooling and feeding portion 24 and accommodating and dispensing portions 25 between which coins can be moved by the transporting unit 22 through the identifying portion 23, the number of coins accommodated in the accommodating and dispensing portion 25 by feeding coins one by one from one accommodating and dispensing portion 25, making the identifying portion 23 identify denominations of the fed coins and the memorizing portion 88 memorize the denominations, accommodating the identified coins into the pooling and feeding portion 24, and feeding and accommodating, after all coins in the accommodating and dispensing portion 25 move to the pooling and feeding portion 24, all the coins in the pooling and feeding portion 24 one by one into the original accommodating and dispensing portion 25.

Next, operation of the first embodiment will be described. First, the summaries of depositing and dispensing processes of the coin depositing and dispensing machine 11 will be described.

Figure 6:
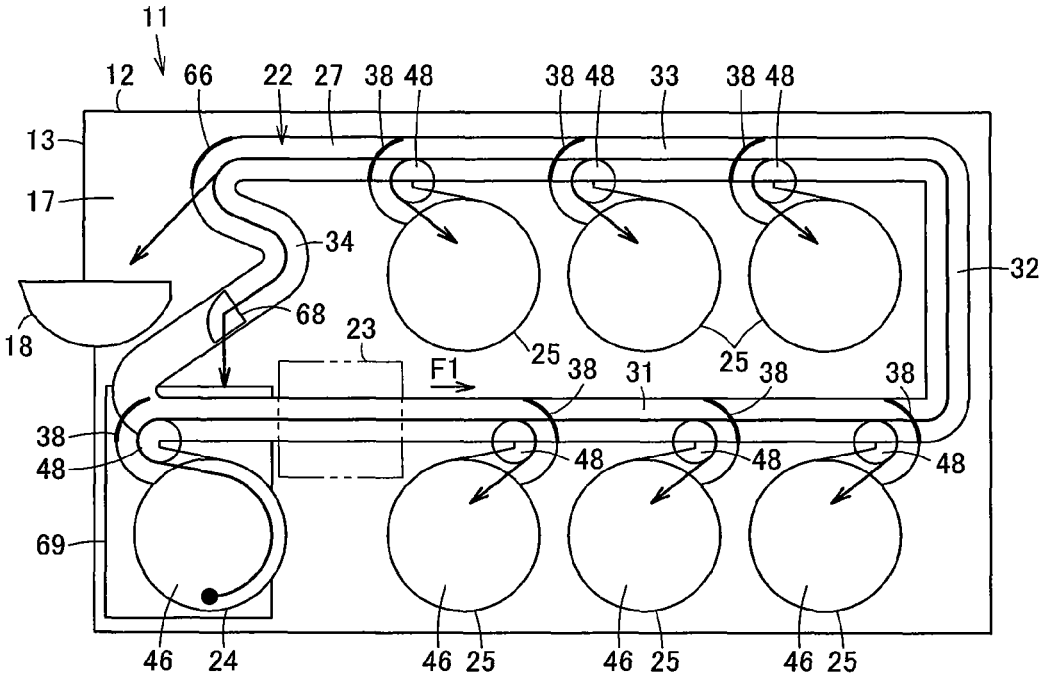
FIG. 6 is an explanatory view showing a depositing process of the coin depositing and dispensing machine.

FIG. 6 shows the depositing process.

Coins to be deposited-input into the coin receiving port 16 by customers, etc., are collectively received and pooled in the pooling and feeding portion 24.

The belt 35 is driven in the depositing and transporting direction F1, the delivering disc 48 of the pooling and feeding portion 24 is simultaneously rotated with the belt 35 in the feeding rotation direction, and the delivering disc 48 of each accommodating and dispensing portion 25 is rotated in the reverse feeding rotation direction.

The rotary disc 46 of the pooling and feeding portion 24 is rotated in the feeding rotation direction, the picking-up members 53 of the rotary disc 46 pick up and deliver coins one by one to the delivering disc 48, the sorting member 38 is here swung to the coin entering and exiting position, and thus the coins are fed by the delivering disc 48 to the coin passage 27. Accordingly, coins are separated one by one and intermittently fed from the pooling and feeding portion 24 to the coin passage 27.

The coins separated one by one and intermittently fed from the pooling and feeding portion 24 to the coin passage 27 enter between a plurality of projecting portions 36 of the rotating belt 35 one by one, are pushed by one side of the projecting portion 36 on the upstream side in the transporting direction, and moved in the coin passage 27 in the depositing and transporting direction F1. Accordingly, coins in the coin passage 27 are separated one by one and intermittently transported by the belt 35.

The denominations of the coins moved in the coin passage 27 in the depositing and transporting direction F1 are identified by the identifying portion 23.

Coins identified as normal coins by the identifying portion 23 are sorted from the coin passage 27 to the coin inlet/outlet 25*a* of the accommodating and dispensing portion 25 by the sorting member 38 of the accommodating and dispensing portion 25 for accommodating coins of the corresponding denomination, and received and accommodated in the accommodating and dispensing portion 25. When a coin is received in the accommodating and dispensing portion 25, the coin is detected by a sensor, and the memorizing portion 88 for memorizing the number of coins accommodated in the accommodating and dispensing portion 25 adds one to the current number of accommodated coins and updates the total number of coins.

Coins identified as abnormal coins by the identifying portion 23 are made to pass through each accommodating and dispensing portion 25 on the coin passage 27, transported to the terminal end of the second passage portion 33, sorted by the dispensing mechanism 66 into the coin dispensing port 17, dispensed to the receptacle 18 and returned.

In the case where the number of coins accommodated in the accommodating and dispensing portion 25 of a certain denomination reaches a predetermined full number, the succeeding coin of the denomination is identified as an overflow coin, transported to the return passage portion 34 of the coin passage 27, diverted from the coin passage 27 by the diverting mechanism 68, and accommodated in the accommodating box 69. When coins to be deposited-input are completely accommodated in the accommodating and dispensing portions 25 or accommodating box 69, the depositing process ends. Moreover, In the case where a customer, etc., confirms approval of depositing after the coins to be deposited-input are completely accommodated in the accommodating and dispensing portions 25 or accommodating box 69, the depositing process ends at a point of time when depositing approval operation is performed by the customer. Additionally, in the case where depositing disapproval operation is performed by the customer, etc., coins corresponding to the coins accommodated in each accommodating and dispensing portion 25 or accommodating box 69 are fed from each accommodating and dispensing portion 25, dispensed from the coin dispensing port 17 to the receptacle 18 and returned. This coin returning process is the same process as the dispensing process described below.

Figure 7:
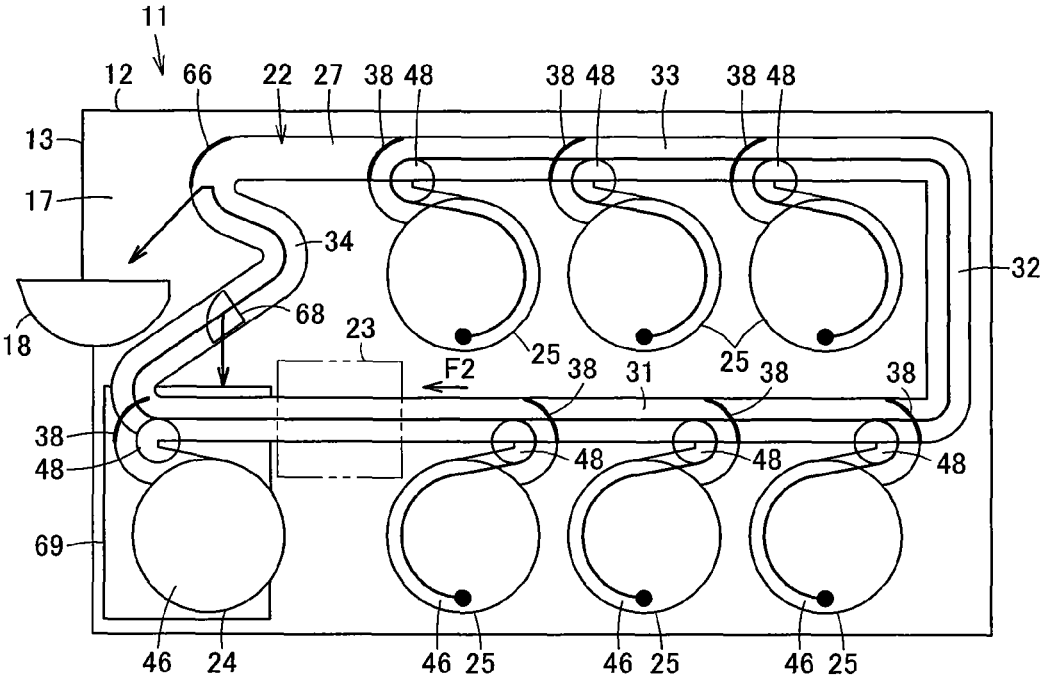
FIG. 7 is an explanatory view showing a dispensing process of the coin depositing and dispensing machine.

FIG. 7 shows the dispensing process.

The belt 35 is driven in the dispensing and transporting direction F2, the delivering disc 48 of the pooling and feeding portion 24 is simultaneously rotated with the belt 35 in the reverse feeding rotation direction, and the delivering disc 48 of each accommodating and dispensing portion 25 is rotated in the feeding rotation direction.

Coins corresponding to denominations inferred from dispensing amount indicated by a customer, etc., are successively fed from the accommodating and dispensing portions 25 by the denomination.

In the accommodating and dispensing portion 25 accommodating coins of the corresponding denomination, the rotary disc 46 is simultaneously rotated with the belt 35 and delivering disc 48 in the feeding rotation direction, coins are picked up one by one by the picking-up members 53 of the rotary disc 46 and delivered to the delivering disc 48. The sorting member 38 is here swung to the coin entering and exiting position, and thus the coins are fed to the coin passage 27 by the delivering disc 48. Accordingly, coins are separated one by one and intermittently fed from the accommodating and dispensing portion 25 to the coin passage 27.

The sensor detects a coin fed from the accommodating and dispensing portion 25, and the memorizing portion 88 for memorizing the number of coins accommodated in the accommodating and dispensing portion 25 subtracts one from the current number of accommodated coins and updates the total number of coins. The coins separated one by one and intermittently fed from the accommodating and dispensing portion 25 to the coin passage 27 enter between a plurality of projecting portions 36 of the rotating belt 35 one by one, are pushed by another side of the projecting portion 36 on the upstream side in the transporting direction, and moved in the coin passage 27 in the dispensing and transporting direction F2. Accordingly, coins in the coin passage 27 are separated one by one and intermittently transported by the belt 35.

The identifying portion 23 identifies denominations of the coins moved in the coin passage 27 in the dispensing and transporting direction F2.

Coins identified as normal coins by the identifying portion 23 are transported to the terminal end of the second passage portion 33 through the returning passage portion 34 of the coin passage 27, sorted into the coin dispensing port 17 by the dispensing mechanism 66, dispensed to the receptacle 18 and dispensed.

Coins identified as abnormal coins by the identifying portion 23 are diverted from the coin passage 27 by the diverting mechanism 68 of the returning passage portion 34 of the coin passage 27, and accommodated in the accommodating box 69. In the case of being short of coins, the coins are additionally fed from the accommodating and dispensing portions 25 corresponding to the denominations of the coins.

When all coins to be dispensed are dispensed from the coin dispensing port 17, the dispensing process ends.

Since all the passage portions 31 to 34 of the transporting unit 22 are thus commonly used in the depositing process and dispensing process of coins, a depositing and transporting route and a dispensing and transporting route are made common to each other.

Figure 8:
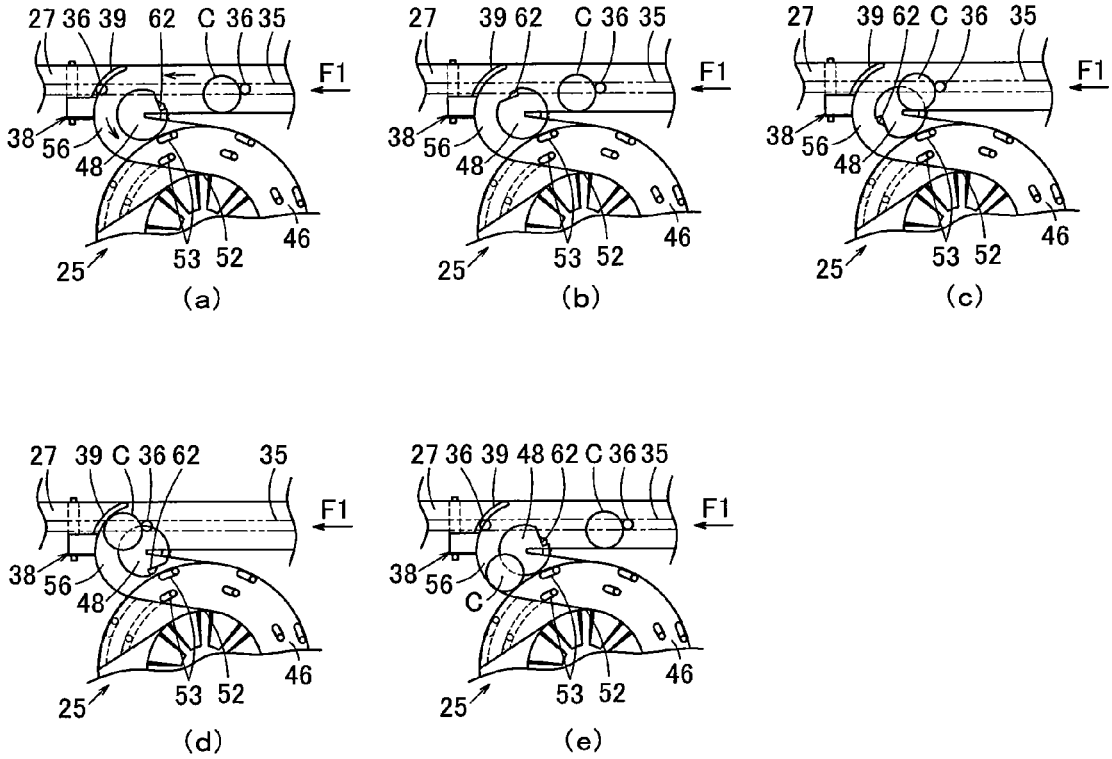
FIGS. 8(*a*) to (*e*) are explanatory views showing a depositing operation of the accommodating and dispensing portion.

Next, sorting and accommodating operation of coins (indicated as the reference symbol C in the figures, but the symbol will be omitted hereinafter) into the accommodating and dispensing portions 25 in the depositing process will be described with reference to FIG. 8. FIG. 8 shows the sorting and accommodating operation of coins into the accommodating and dispensing portions 25 arranged on the second passage portion 33 of the coin passage 27.

In depositing coins, the belt 35 is driven in the depositing and transporting direction F1, and the delivering disc 48 of the accommodating and dispensing portion 25 is simultaneously rotated with the belt 35 in the reverse feeding rotation direction. The rotary disc 46 of the accommodating and dispensing portion 25 is not rotated.

As shown in FIGS. 8(*a*), (*b*) and (*c*), a coin is pushed by the projecting portion 36 of the rotating belt 35 on the upstream side in the transporting direction, and moved in the depositing and transporting direction F1. When the sensor at the coin passage 27 detects a coin to be accommodated in the accommodating and dispensing portion 25 is transported, the sorting member 38 is swung to a coin entering and exiting position where the coin guiding portion 39 projects sorting member 38 from the passage face 29 of the coin passage 27 and the blocking portion 40 makes the coin inlet/outlet 25*a* open.

Since a support underlying a coin disappears when the coin reaches the position of the opened coin inlet/outlet 25*a*, the coin can enter the coin inlet/outlet 25*a*. Further, as shown in FIGS. 8(*d*) and (*e*), a coin pushed by the projecting portion 36 of the belt 35 comes into contact with the concavely curved face-shaped coin guiding portion 39 of the sorting member 38, and thus forcibly directed reversely toward the coin inlet/outlet 25*a* along the concavely curved face-shaped coin guiding portion 39 and sorted, and the sorted coin is received from the guide passage 56 into the accommodating and dispensing portion 25.

At this time, the projecting body 62 of the delivering disc 48 revolves at a position of not obstructing the entrance of coins from the coin passage 27 to the coin inlet/outlet 25*a*. Additionally, even in the case where the quantity of coins accommodated in the accommodating and dispensing portion 25 increases, coins received from the coin inlet/outlet 25*a* lie in a row at the guide passage 56, and the last received coin stops in the vicinity of the coin inlet/outlet 25*a*, the projecting body 62 of the delivering disc 48 revolves to the stopping coin as shown in FIG. 4 and thus the stopping coin runs up onto the tilted face 64 of the projecting body 62, forcibly floats from the guide passage 56 and drops into the hopper 47. Thus, the accommodation capacity of coins, which can be actually accommodated in the accommodating and dispensing portion 25, can be increased.

Figure 9:
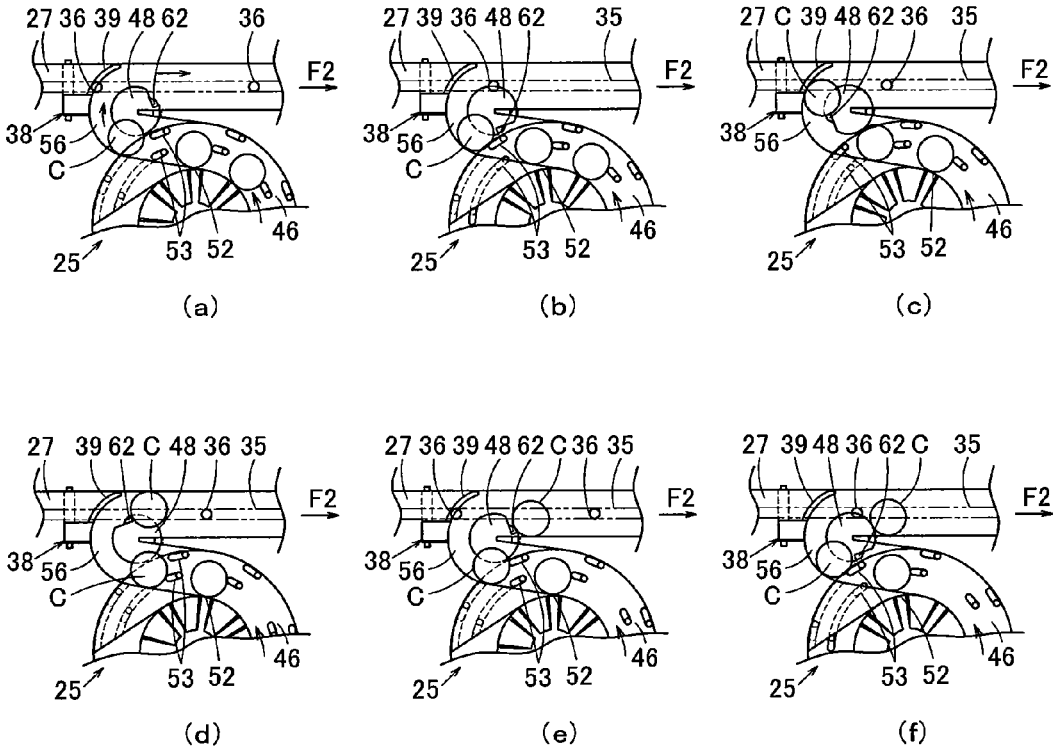
FIGS. 9(*a*) to (*f*) are explanatory views showing a dispensing operation of the accommodating and dispensing portion.

Next, feeding operation of coins from the accommodating and dispensing portion 25 in the dispensing process will be described with reference to FIG. 9. FIG. 9 shows the feeding operation of coins from the accommodating and dispensing portion 25 arranged on the second passage portion 33 of the coin passage 27.

In dispensing, the belt 35 is driven in the dispensing and transporting direction F2, and the delivering disc 48 of the accommodating and dispensing portion 25 is simultaneously rotated with the belt 35 in the feeding rotation direction. The rotary disc 46 of the accommodating and dispensing portion 25 is simultaneously rotated with the belt 35 and delivering disc 48 in the feeding rotation direction.

As shown in FIGS. 9(*a*) and (*b*), the picking-up member 53 on the inner circumference side of the rotary disc 46 holds coins one by one between the member 53 and the coin circumference holding portion 52 and picks up the coin to the upper region of the rotary disc 46, and the picking-up member 53 on the outer circumference side pushes out the coin, which is picked up to the upper region of the rotary disc 46 by the picking-up member 53 on the inner circumference side, to the guide passage 56 toward the coin inlet/outlet 25*a*.

Here, the projecting body 62 of the delivering disc 48 revolves at a position of not obstructing the entrance of coins from the rotary disc 46 to the guide passage 56.

As shown in FIG. 9(*b*), the projecting body 62 of the delivering disc 48 revolves to a position of the coin pushed out by the picking-up member 53 on the outer circumference side from the rotary disc 46 to the guide passage 56, and thus receives the coin from the picking-up member 53 on the outer circumference side and feeds it while pushing it to the coin inlet/outlet 25*a*.

When the sensor provided at the guide passage 56 detects the coin, the sorting member 38 is swung to the coin entering and exiting position where the coin guiding portion 39 projects from the passage face 29 of the coin passage 27 and the blocking portion 40 makes the coin inlet/outlet 25*a* open.

As shown in FIGS. 9(*c*), (*d*) and (*e*), the coin pushed and fed by the projecting body 62 of the delivering disc 48 enters the coin passage 27 from the coin inlet/outlet 25*a*, enters between projecting portions 36 of the belt 35 while moving along the concavely curved face-shaped coin guiding portion 39 of the sorting member 38, is guided to the side of the coin inlet/outlet 25*a* in the dispensing and transporting direction F2, and moves from the projecting body 62 of the delivering disc 48 onto the lower guide side plate 30 of the coin passage 27.

A shown in FIG. 9(*f*), the projecting portion 36 on the upstream side of the belt 35 in the transporting direction comes into contact with the coin on the lower guide side plate 30 of the coin passage 27, and transports the coin in the dispensing and transporting direction F2.

Figure 10:
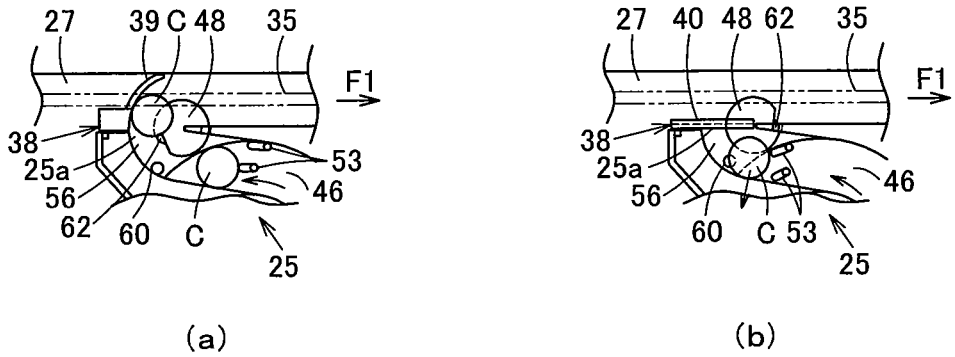
FIGS. 10(*a*) and (*b*) are explanatory views showing an operation of the accommodating and dispensing portion in dispensing stop.

As shown in FIG. 10(*a*), when the sensor at the guide passage 56 detects coins of necessary pieces are fed from the accommodating and dispensing portion 25, the rotary disc 46 is stopped. As shown in FIG. 10(*b*), at a timing that the last fed coin completely enters the coin passage 27, the sorting member 38 is swung to a coin passing position where the coin guiding portion 39 is buried in the passage face 29 of the coin passage 27 and the blocking portion 40 makes the coin inlet/outlet 25*a* close.

Figure 11:
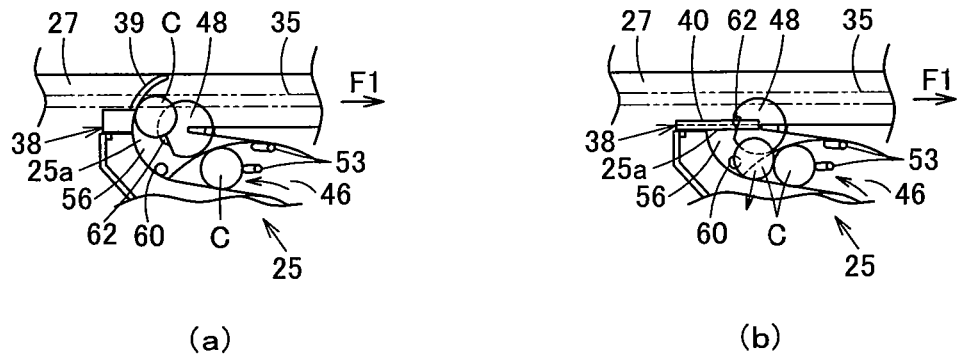
FIGS. 11(*a*) and (*b*) are explanatory views showing a double-coin-feed preventing operation of the accommodating and dispensing portion.

The rotary disc 46 does not immediately stop and the succeeding coin is fed from the rotary disc 46 into the guide passage 56, even if the rotary disc 46 is operated so as to stop. However, if the sorting member 38 is swung to the coin passing position and simultaneously the projecting portion 60 is projected from the passage face 29 of the guide passage 56, the succeeding coin fed into the guide passage 56 from the rotary disc 46 is dropped into the hopper 47. Thus, contact of the succeeding coin with the blocking portion 40, which has made the coin inlet/outlet 25*a* close, of the sorting member 38 can be prevented from causing damage of the sorting member 38 and a coin jam. Additionally, as shown in FIGS. 11(*a*) and (*b*), in the case where a coin goes away from the projecting body 62, drops into the guide passage 56 and continues to the succeeding coins in the midst of being fed to the coin passage 27 by the projecting body 62 of the delivering disc 48, the sensor at the guide passage 56 detects the dropped coin at this timing, generation of dropping of the coin from the projecting body 62 is recognized, the sorting member 38 is swung to the coin passing position and simultaneously the projecting portion 60 is projected from the passage face 29 of the guide passage 56, and thus the two continuing coins in the guide passage 56 are dropped into the hopper 47. Thus, two continuing coins can be prevented from being fed together.

Moreover, although the operation of the accommodating and dispensing portion 25 is here described, sorting and accommodating operation of coins into the pooling and feeding portion 24 and feeding operation of coins from the pooling and feeding portion 24 are similar to the operations of the accommodating and dispensing portion 25, respectively.

Since coins thus can be made to enter and exit the transporting unit 22 through the single coin inlet/outlet 25*a* of the accommodating and dispensing portion 25 in the coin depositing and dispensing machine 11, the depositing and transporting route and dispensing and transporting route of the transporting unit 22 can be made common to each other, and a coin depositing and dispensing machine 11 further downsized can be provided.

Additionally, since coins are accommodated in the accommodating and dispensing portion 25 in a non-aligned state, no conventional problem arises such that coins cannot be correctly accommodated and stand in the case of piling up and accommodating the coins in a cylinder. Thus, coins can be securely accommodated and dispensed. Further, basic constitutions of the pooling and feeding portion 24 and accommodating and dispensing portion 25 can be made common to each other.

Additionally, the layout is that, the transporting unit 22 includes: the first passage portion 31 provided so as to run from the front side to the rear side of the machine body 12; the turning passage portion 32 for turning the coin passage from the terminal end of the first passage portion 31 to the front side of the machine body 12; and the second passage portion 33 provided so as to run from the terminal end of the turning passage portion 32 to the front side of the machine body 12 and have the terminal end directed to the coin dispensing port 17, the identifying portion 23 and a plurality of accommodating and dispensing portions 25 are provided on the first passage portion 31 in this order along the transporting direction of driving the transporting unit 22 in the depositing and transporting direction F1, and therefore the coin depositing and dispensing machine 11 can be downsized. Particularly, since the accommodating and dispensing portions 25 are dividedly arranged on the first passage portion 31 and second passage portion 33, the dimensions of the machine body 12 in a front and rear direction can be reduced.

Additionally, in the pooling and feeding portion 24 and any one of the accommodating and dispensing portions 25 between which coins can be moved by the transporting unit 22 through the identifying portion 23, coins are fed one by one from the accommodating and dispensing portion 25, the denomination of the fed coins are identified by the identifying portion 23 and memorized by the memorizing portion 88, the identified coins are accommodated into the pooling and feeding portion 24, all coins in the accommodating and dispensing portion 25 are moved to the pooling and feeding portion 24 and thereafter fed and accommodated one by one into the original accommodating and dispensing portion 25, and thus the number of coins accommodated in each accommodating and dispensing portion 25 can be investigated.

Figure 12:
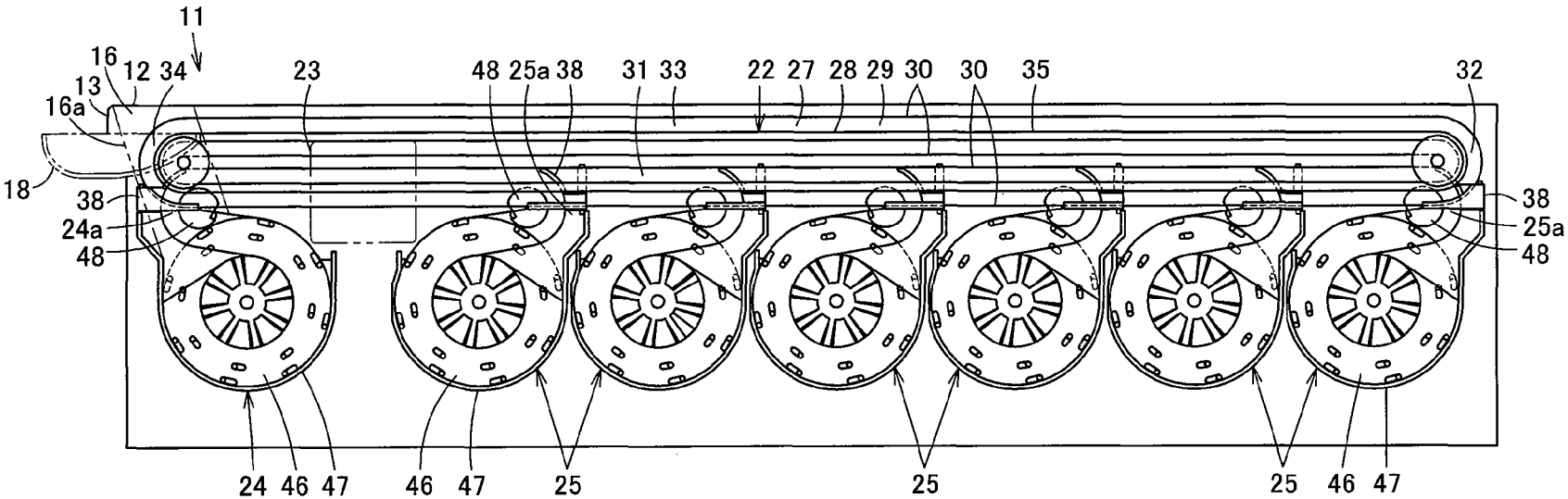
FIG. 12 is a side view showing an inner structure of a coin depositing and dispensing machine to which a coin accommodating and dispensing device of another embodiment of the present invention is applied.

FIG. 12 shows another embodiment.

A plurality of accommodating and dispensing portions 25 are arranged only along the first passage portion 31 of the transporting unit 22. In comparison with the coin depositing and dispensing machine 11 of the above embodiment, a coin depositing and dispensing machine 11 of this embodiment is longer in the front and rear direction and lower in a vertical direction, and more suitable for machines required to be low.

Figure 13:
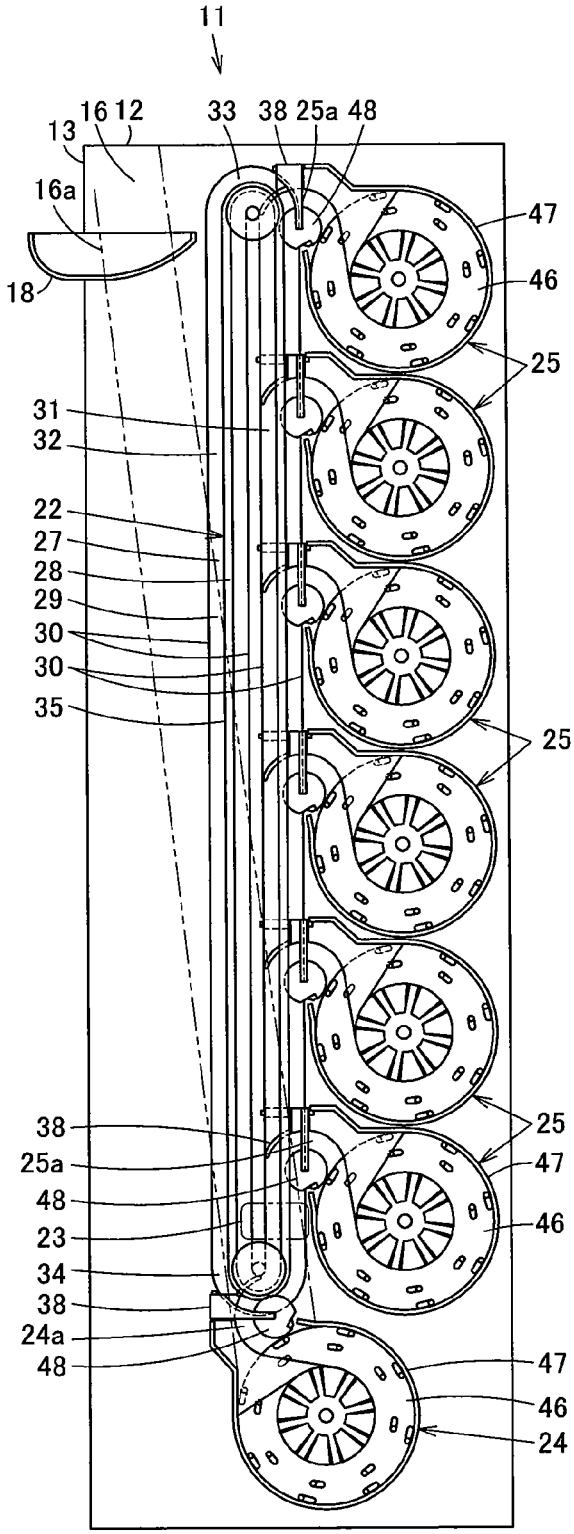
FIG. 13 is a side view showing an inner structure of a coin depositing and dispensing machine to which a coin accommodating and dispensing device of an embodiment of the present invention is applied.

FIG. 13 shows a further embodiment.

A passage direction of the first passage portion 31 and second passage portion 33 of the transporting unit 22 is set as a vertical direction, the pooling and feeding portion 24, the identifying portion 23 and a plurality of accommodating and dispensing portions 25 are arranged in this order upward from the lower side of the first passage portion 31. In comparison with the coin depositing and dispensing machine 11 of the above embodiment, a coin depositing and dispensing machine 11 is higher in the vertical direction, however, it can be further shortened in the front and rear direction, and is more suitable for machines required to have a short depth.

Moreover, in the above embodiments, a temporary storing portion may be provided which can make coins enter and exit the transporting unit 22 and temporarily stores the coins. The temporary storing portion temporarily stores coins, which are received from the outside of the machine body 12 into the coin receiving port 16 and identified as normal coins by the identifying portion 23, until the approval of depositing is confirmed, and the coins temporarily held in the temporary storing portion are fed after confirmation of the approval of depositing, and may be accommodated in the accommodating and dispensing portions 25 in the case of the approval of depositing, or returned from the coin dispensing port 17 in the case of disapproval of depositing. The temporary storing portion may have the same basic constitution as that of the pooling and feeding portion 24 or accommodating and dispensing portion 25, and can make coins enter and exit the coin passage 27. As the temporary storing portion, an exclusive temporary storing portion may be used, or one of the accommodating and dispensing portions 25 may be used. When coins accommodated in the temporary storing portion are accommodated into the accommodating and dispensing portions 25, all the coins in the temporary storing portion are fed to the coin passage 27 and accommodated in the pooling and feeding portion, and then fed from the pooling and feeding portion and accommodated in each accommodating and dispensing portion 25, for example.

The present application is applied to coin depositing and dispensing machines, etc., of, for example, a cash register in a store, or, in a financial institution, a counter or an ATM (Automatic Tellers Machine) installed inside or outside a banking branch.

The invention claimed is:

1. A coin accommodating and dispensing device comprising:

a transporting unit transporting coins one by one along a surface; and an accommodating and dispensing portion provided with a rotary disc which rotates at a position of tilting at a predetermined angle relative to a horizontal direction;

a hopper accommodating coins at a surface side of the rotary disc; and a coin inlet/outlet through which coins enter and exit the transporting unit from an upper region of the rotary disc, for receiving coins transported one by one by the transporting unit through the coin inlet/outlet, accommodating the coins therein not in an aligned manner, and dispensing accommodated coins one by one through the coin inlet/outlet to the transporting unit, said inlet/outlet being on a plane along the surface of the rotary disc and the surface of the transporting unit.

2. The coin accommodating and dispensing device according to claim 1, wherein a plurality of accommodating and dispensing portions are provided along the transporting unit.

3. The coin accommodating and dispensing device according to claim 1, wherein the transporting unit can transport coins in a normal or reverse direction.

4. The coin accommodating and dispensing device according to claim 1, further comprising:

an identifying portion identifying denominations of coins transported by the transporting unit; and a controlling portion sorting the coins transported by the transporting unit into the accommodating and dispensing portion in accordance with identification results of the identifying portion.

5. The coin accommodating and dispensing device according to claim 1, further comprising:

an identifying portion identifying denominations of coins transported by the transporting unit; and a sorting member sorting the coins transported by the transporting unit into the accommodating and dispensing portions in accordance with identification results of the identifying portion.

6. The coin accommodating and dispensing device according to claim 5, further comprising a controlling portion driving the transporting unit in a first direction when coins are accommodated in the accommodating and dispensing portions, and driving the transporting unit in a second direction different from the first direction when coins are dispensed from the accommodating and dispensing portions, wherein the transporting unit includes a coin passage which transports coins and has, in its width direction, one side in which the coin inlets/outlets of the accommodating and dispensing portions are provided, and the sorting member includes:

a coin guiding portion provided so that one side, which is located at the coin inlet/outlet side of the coin passage, of the guiding portion is, relative to another side located at a side opposite from the coin inlet/outlet, tilted toward a downstream side, at a predetermined angle, in a transporting direction when the transporting unit is driven in the first direction, and is provided in a concavely curved face shape facing an upstream side in a transporting direction when the transporting unit is driven in the first direction; and a blocking portion preventing coins from entering the coin inlet/outlet.

7. The coin accommodating and dispensing device according to claim 6, wherein the sorting member is electrically driven, the coin guiding portion projects from the coin passage and the blocking portion makes the coin inlet/outlet open when coins are sorted into the accommodating and dispensing portion, and the coin guiding portion is buried in the coin passage and the blocking portion makes the coin inlet/outlet block when no coin is sorted into the accommodating and dispensing portion.

8. The coin accommodating and dispensing device according to claim 1, wherein the accommodating and dispensing portion includes:

a picking-up member which project from the surface of the rotary disc and pick up accommodated coins one by one by rotation of the rotary disc; and a delivering disc disposed in the vicinity of the coin inlet/outlet, and receives and delivers the coins picked up one by one by the picking-up member at a predetermined interval to the transporting unit.

9. The coin accommodating and dispensing device according to claim 8, wherein the delivering disc includes, in its outer circumference, at least one projecting body for coming into contact with a coin.

10. The coin accommodating and dispensing device according to claim 1, wherein the transporting unit comprises:

an endless transporting body; and a plurality of projecting portions which project from the transporting body, and push and transport coins one by one.

11. The coin accommodating and dispensing device according to claim 10, further comprising a controlling portion driving the transporting unit in a first direction when coins are accommodated in the accommodating and dispensing portions, and driving the transporting unit in a second direction different from the first direction when coins are dispensed from the accommodating and dispensing portions.

12. The coin accommodating and dispensing device according to claim 10, wherein the transporting unit transports coins, in a manner that the lateral face of the one side of the projecting portion comes into contact with the coin, when the coins are accommodated in the accommodating and dispensing portions, and transports coins, in a manner that the lateral face of another side of the projecting portion comes into contact with the coin, when coins are dispensed from the accommodating and dispensing portions.

* * * * *